US007506484B2

(12) United States Patent
Geller

(10) Patent No.: US 7,506,484 B2
(45) Date of Patent: Mar. 24, 2009

(54) DRAWER OR DOOR FRONT ASSEMBLY WITH INTEGRAL PORT

(76) Inventor: Gary Robert Geller, 15 SE. 15 Ave., Fort Lauderdale, FL (US) 33301

( * ) Notice: Subject to any disclaimer, the term of this patent is extended or adjusted under 35 U.S.C. 154(b) by 688 days.

(21) Appl. No.: 10/883,608

(22) Filed: Jul. 1, 2004

(65) Prior Publication Data

US 2006/0001338 A1 Jan. 5, 2006

(51) Int. Cl.
*E04H 12/18* (2006.01)

(52) U.S. Cl. ..... 52/784.1; 52/784.12; 220/315

(58) Field of Classification Search ..... 52/784.13, 52/784.16, 784.1, 784.12, 783.1, 792.1, 792.11, 52/204.54, 212, 171.1, 204.53, 204.69, 456; 312/348, 263; 29/897.32; 220/315; 174/559, 174/DIG. 9, 560, 561, 562, 563
See application file for complete search history.

(56) References Cited

U.S. PATENT DOCUMENTS 997,677 A * 7/1911 Ivey ..... 52/657
1,848,715 A 3/1932 Hart et al.
2,912,725 A 11/1959 Ries
3,333,385 A * 8/1967 King ..... 52/730.6
3,524,691 A * 8/1970 Moore ..... 312/286
4,327,535 A * 5/1982 Governale ..... 52/309.11
4,387,545 A 6/1983 Kern
4,589,240 A 5/1986 Kendall et al.
5,161,870 A * 11/1992 Mason et al. ..... 312/348.4
5,384,103 A 1/1995 Miller
5,533,312 A 7/1996 Mihalcheon
5,644,870 A 7/1997 Chen
5,951,133 A * 9/1999 Dittberner et al. ..... 312/348.4
6,088,993 A 7/2000 Irace
6,099,095 A 8/2000 Irace
6,132,540 A * 10/2000 Barber et al. ..... 156/78
6,161,363 A 12/2000 Herbst
6,357,610 B1 3/2002 Irace
6,449,916 B1 9/2002 Waters
6,526,707 B2 * 3/2003 Tucker ..... 52/211
6,553,735 B1 4/2003 Wang Chen
6,619,005 B1 9/2003 Chen
6,622,449 B2 * 9/2003 Smith et al. ..... 52/656.9
6,691,483 B2 2/2004 Lethers
6,729,095 B2 5/2004 Wang Chen
6,931,810 B2 8/2005 Beaudoin et al.
7,100,342 B2 9/2006 Holloway

* cited by examiner

*Primary Examiner*—Richard E Chilcot, Jr.
*Assistant Examiner*—Anthony N Bartosik

(57) ABSTRACT

An interlocking drawer or door assembly has a rear panel and a front panel that each have corresponding openings. Perimeter portions around the openings in the two panels are formed to capture an insert panel. An escutcheon plate covers raw edges of the perimeter around the insert opening. The rear panel is fastened to the front panel to create the assembly.

13 Claims, 3 Drawing Sheets

DRAWER OR DOOR FRONT ASSEMBLY WITH INTEGRAL PORT

CROSS REFERENCE TO RELATED APPLICATION

This application is related to application Ser. No. 10/831,858 entitled "DRAWER OR DOOR FRONT ASSEMBLY", filed Apr. 26, 2004.

FIELD OF THE INVENTION

This invention relates generally to interlocking panel assemblies, and more particularly to drawer fronts or door fronts for cabinets.

BACKGROUND

Drawer and door fronts for cabinets, such as kitchen, bathroom or other storage units have traditionally been manufactured from wood, wood by-products, metal and/or plastic. Typically, these fronts are made from multiple pieces, fastened together using mechanical fasteners such as nails, screws, bolts, welds, adhesives, etc. This not only complicates the design of the door or drawer fronts, but adds to the material cost and the labor cost. In situations where metal is used to fabricate the door or drawer fronts, two panels, a front and a rear, are traditionally fastened together to create an assembly by spot-welding or using screw-type fasteners. The problem with each of these fastening methods is that, in addition to high labor costs, they leave obvious and unsightly evidence of their presence on the exterior of the door or drawer front, and that is unacceptable in many markets.

Additionally, when sheet metal is formed to create the panels of the door or drawer front, the juncture at the corners where the vertical walls of the panels meet leaves a gap that is also unsightly and undesirable. Some have chosen to arc or gas weld this joint, and then grind down the weld to attempt to create a visually pleasing joint, but even with the finest craftsmanship, the ground weld leaves evil notice of its presence. This problem manifests itself not only on the outside corners of the panel, but also on inside corners. If one desires to incorporate an opening in the panel, the edges and corners of the opening need to be treated to alter any rough edges for both safety and aesthetics. The usual method is to provide some sort of post-assembly trim or fascia around the border of the opening to mask the cut edges, or to carefully smooth and polish the cut edges, but this requires extra material and/or extra assembly steps, each increasing the end product cost, and obviates the creation of an opening with a clean, modern appearance. It would be a valuable addition to the art if a method to create an opening in a metal drawer or door front could be designed that would obviate the need for these extra trim pieces or extra labor steps, and would have smooth and uniform edges to create an aesthetically pleasing and cost effective panel.

BRIEF DESCRIPTION OF THE DRAWINGS

The features of the invention, both as to organization and method of operation, together with objects and advantages thereof, may be best understood by reference to the following detailed description, which describes certain exemplary embodiments of the invention, taken in conjunction with the accompanying drawings in which.

DETAILED DESCRIPTION

Figure 1:
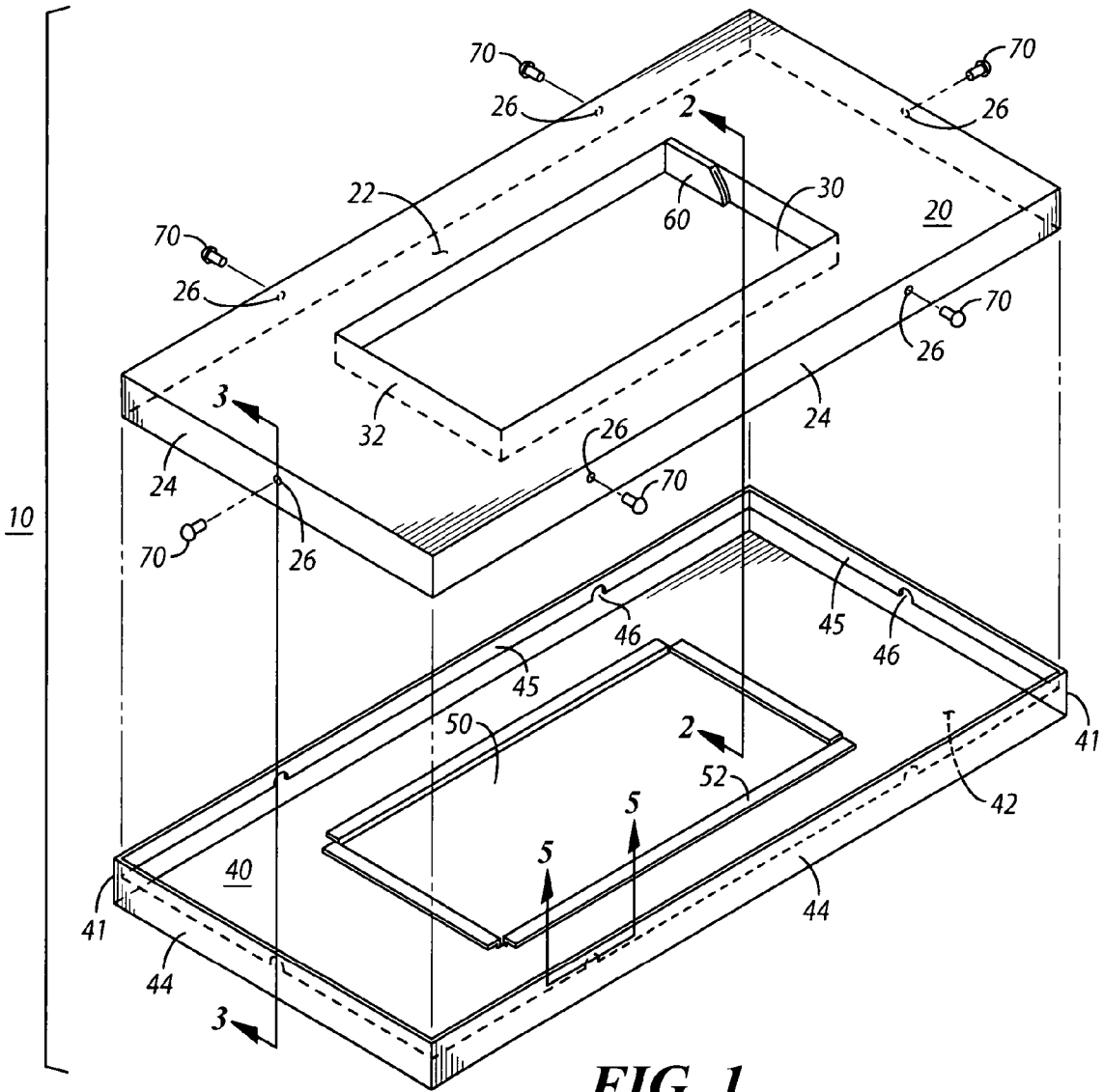
FIG. 1 is an exploded perspective view consistent with certain embodiments of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding elements in the several views of the drawings. Referring now to FIG. 1, an exploded perspective view, and FIG. 2, a cross sectional view of one embodiment of the invention, a drawer front assembly 10 or similar item consists of an outer or front panel 40 and an inner or rear panel 20. Although a drawer front assembly is used as an example to describe the invention, other types of assemblies can also utilize this technique, such as hinged doors, sliding doors, panels, shelves, etc, and still fall within the scope and spirit of the invention. Both the outer and inner panels 40, 20 are typically made of sheet metal, for example steel, stainless steel, aluminum, brass, or copper, and are typically formed to create a five sided rectangular box, although other shapes are envisioned, such as circles, ellipses and polygons, with one side open to form a cavity.

Figure 2:
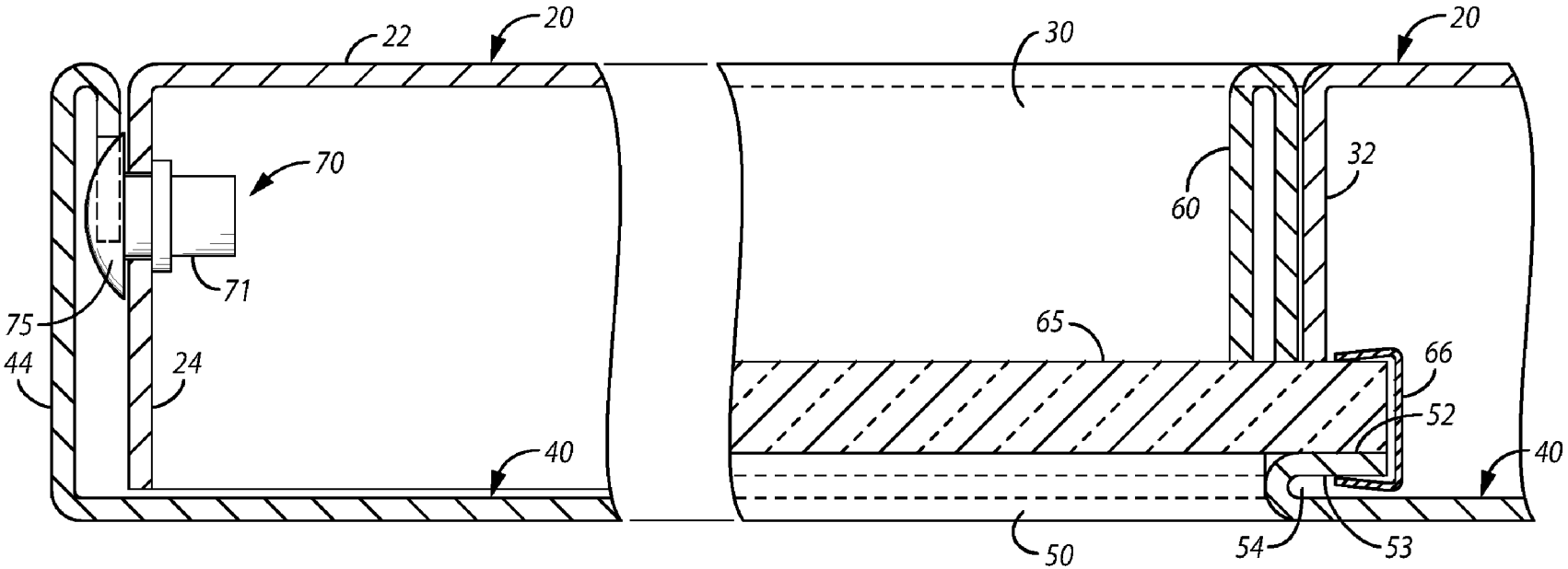
FIG. 2 is a cross-sectional view of a portion of FIG. 1, consistent with certain embodiments of the present invention.

The rear panel 20 has an opening or port 30 formed therein. Although depicted in the drawing as a rectangle, the opening 30 can be any shape, such as square, rectangular, round, elliptical, polygonal, etc, depending on the desire and whim of the designer, and can be located anywhere on the major face or plane 22 of the panel. Surrounding the opening 30 is a perimeter wall 32 that is formed to frame the opening. This is typically accomplished by inwardly bending a portion of the major plane that is at the periphery of the opening so that it is perpendicular to the major plane to form the wall 32. The second or front panel 40 likewise has an opening or port 50 created in the major plane 42 that corresponds to the opening 30 in the rear panel 20. Surrounding the opening 50 is a perimeter portion 52 that is formed in a 'U' shape such that one leg 53 of the 'U' is approximately parallel to the major plane 42 and such that the open portion 54 of the 'U' shape faces away from the opening 50. A trim piece or escutcheon plate 60 that serves to cover the raw edges of the wall 32 is formed to fit inside the opening on the side of the wall 32 that faces the opening 30. FIG. 2 shows the escutcheon plate 60 formed as a flattened 'U' but other shapes and configurations will serve and can be substituted as necessary. The escutcheon plate 60 is attached, to the outside face of the wall 32, typically by welding, but can also be held in place by clips, adhesives, or mechanical fasteners. The rear panel 20 is then joined to the front panel 40 in a suitable fashion in order to form the door or drawer assembly. Optionally, an insert panel 65, such as a sheet of glass or other transparent, translucent, or opaque material, is disposed in the opening 30, 50 formed in the door assembly 10. In one embodiment, the insert panel 65 is held in place by a 'C' clip 66, but other fastening methods such as adhesives, snap fits, or mechanical fasteners can also be employed. The various features are appropriately dimensioned so that when assembled, the insert panel 65 is captured between the escutcheon plate 60 and the 'U' shaped portion 52 on the front panel.

An alternate embodiment of the invention utilizes a similar construction, however, the opening 50 is simply formed in the front panel 40 without forming a bent hem portion 52 around the opening. While this embodiment does not provide for a means of mechanically fastening the insert panel into the assembly using the 'C' clips described above, one can adhesively bond the insert panel to the inside face of the front panel to retain it in place. The cut edges of the perimeter of the opening 50 would, of course, be treated in a suitable fashion to render them smooth and attractive, as there would not be a formed metal border around the opening.

Figure 3:
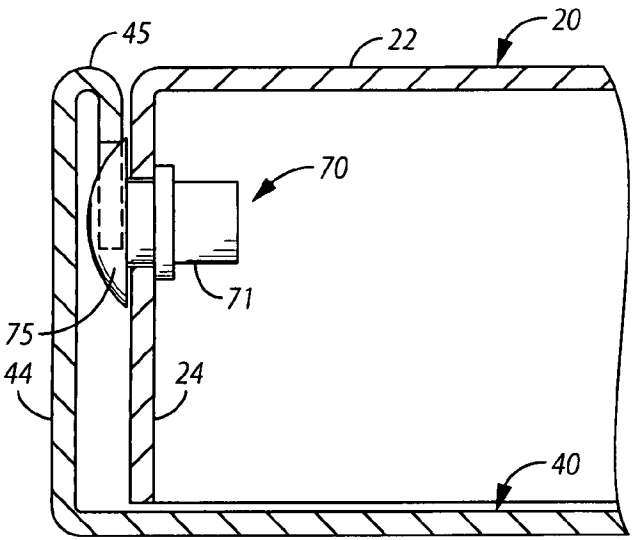
FIG. 3 is a cross-sectional view of another portion of FIG. 1, consistent with certain embodiments of the present invention.

Although the rear panel 20 can be assembled to the front panel 40 in a number of ways such as welds, adhesives, snap fits, or mechanical fasteners, I find the following method of joining particularly suitable to form an aesthetically pleasing and cost effective door or drawer panel assembly. Referring now to FIG. 3, the two panels are dimensioned so that the inner or rear panel 20 nests inside of the cavity in the outer panel 40, with the open cavities of both the outer and inner panels facing each other. The inner panel 20 is formed to have a portion of each perimeter portion bent at a right angle to the major face 22 to form an outer perimeter wall 24 so that vertical edges of adjacent walls are in close proximity and form a seam at each corner. One or more holes or apertures 26 are formed at strategic locations on two or more of the walls 24 to subsequently receive the body 71 of a deformable member 70, such as a plastic rivet. The exact number and spacing of the apertures will, of course, vary with the dimensions of each unique drawer or door front, and a mechanical designer with ordinary skill in the art will understand that conventional design principles shall guide in the placement and number of the holes or apertures 26.

The outer or front panel 40 is also formed so as to have a portion of each perimeter portion bent at a right angle to the major face 42 to form an outer perimeter wall 44. The walls 44 are formed such that the vertical edges of adjacent walls are in close proximity and form a seam 41 at each corner, similar to the inner panel 20.

Figure 4:
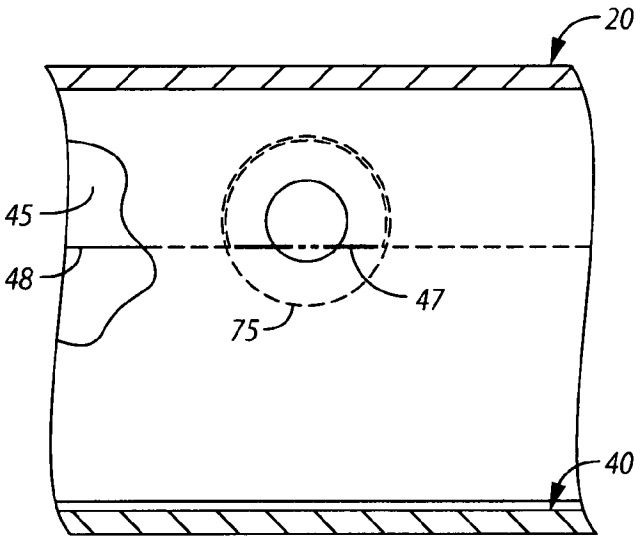
FIG. 4 is an elevational view of a portion of the assembly, viewed from the interior, consistent with certain embodiments of the present invention.
Figure 5:
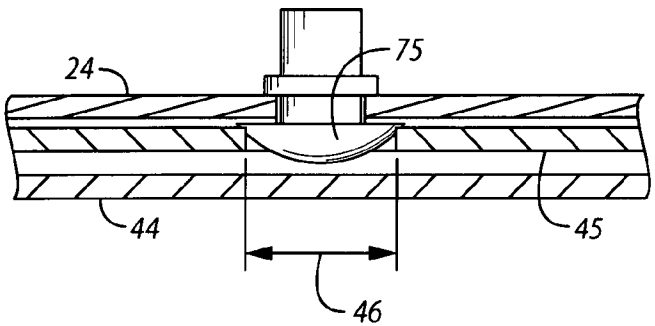
FIG. 5 is a cross-sectional view of FIG. 1, consistent with certain embodiments of the present invention.

However, unlike the inner panel, each wall 44 has an additional formed portion 45 that is created by further bending an end portion of the wall 44 180° to create a 'rolled edge' or hem that faces the cavity side. The dimensions of the outer panel 40 are arranged so that the inner panel 20 will fit precisely into the cavity of the outer panel with little 'play' or interference. Generally, the designer will wish to have the major face 22 of the inner panel coplanar to the top of the rolled edge of the outer panel, as shown in the drawing figures, but other embodiments that place the major face above or below the rolled edge are also envisioned. Partial apertures 46 that have one portion of the perimeter of the aperture open, are formed in the rolled edge at locations that correspond to the locations of the holes 26 in the inner panel. Referring now to FIG. 4, a chord 47 of the aperture is in line with the end 48 of the rolled edge 45 to create a shape that can capture the head of the deformable member. The diameter of the aperture 46 is dimensioned to be slightly smaller than the major diameter of the head 75 of the deformable member 70 so as to create an interference fit between the head of the deformable member and the aperture, as shown in FIG. 5. A shaped aperture that is slightly larger than a semicircle is depicted in the drawings, but other shapes will occur to one skilled in the art, such as a semicircle, a square or rectangular aperture, a triangular aperture in the shape of an inverted 'V', or an aperture that is less than a semicircle.

One example of a deformable member 70 that I find suitable is a plastic snap rivet, but other deformable members such as plastic screws, rubber plugs, bumpers, or buttons can be substituted. Referring again to FIGS. 1 and 3, the plastic rivets are inserted and secured into each of the holes 26 so that the head 75 of the rivet is on the outside of the inner panel 20. The assembly 10 is put together by inserting the inner panel 20 into the outer panel 40 to form a closed box such that the cavity sides of each panel face each other, and the major faces 22, 42 are on the outside of the assembly. Since the head 75 of the deformable member 70 is slightly larger than the partial aperture 46, the inner panel needs to be forced into the outer panel. The head 75 of each rivet deforms as it passes by the smaller apertures 46, locking the inner and outer panels securely together. The head of the rivet also causes the formed wall 44, to deflect outward as the two panels are fit together, until such point when the head of the rivet passes the smooth metal on the wall and 'falls' into the aperture 46, whereupon the formed wall 44, deflects back into the original position.

In order to create an assembly that is dimensionally accurate, pleasing to the eye and tight fitting, the various features of each of the panels 20, 40 are created by cutting with a laser, as opposed to stamping, drilling or other mechanical cutting procedures. In addition, the seam 41 at the outside corners of the outer panel 40, and optionally, some portions of the assembly at the opening 30, 50, are welded with a pulsed YAG laser. Laser welding produces a corner that needs little, if any, subsequent cleaning or polishing operations, and is mechanically solid, precise, and pleasing to the eye. Pulsed YAG lasers are preferred over $CO_2$ lasers because they can produce a smaller and cleaner weld without the heat buildup and subsequent puddling, voiding and distortion that occurs when using $CO_2$ lasers or conventional welding. The seams at the inside corners of the rolled edges 45 need not be welded, but if desired, one can also laser weld them using the same YAG laser techniques. I have found that the corners of the inner panel 20 do not need to be laser welded, in contrast, when they are not welded or otherwise fastened together they have additional compliance, which aids in fitting the two panels together.

In summary, without intending to limit the scope of the invention, a drawer or door front assembly according to certain embodiments of the invention can be created with an integral opening or port. While the invention has been described in conjunction with specific embodiments, it is evident that many alternatives, modifications, permutations and variations will become apparent to those of ordinary skill in the art in light of the foregoing description.

What is claimed is:

1. A door or drawer assembly having a port therein, comprising:

a first panel having a major plane and four outer walls formed at right angles to the major plane, two or more of the walls having apertures disposed therein, and having a port in the major plane, a portion of the major plane at a perimeter of the port formed perpendicular to the major plane to form a wall around the perimeter of the port;

deformable members each having a head portion and a body portion, the head portion being larger than the body portion, the body portion disposed in the apertures such that the head portion is on an exterior face of the outer walls;

an escutcheon plate fastened to the perpendicularly formed wall on the side of the wall that faces the port;

a second panel having a major plane, four outer walls at right angles to the major plane with partial apertures formed in two or more of the second panel outer walls such that at least one portion of a perimeter of each partial aperture is open and facing the major plane, and having a port in the major plane corresponding to the port in the first panel, a portion of the second panel major plane at a perimeter of the port formed in a 'U' shape such that one leg of the 'U' is approximately parallel to the second panel major plane and the open portion of the 'U' shape faces away from the port; and wherein when the first panel is assembled to the second panel the deformable member head portions deform and are captured in the respective partial apertures in the second panel outer walls to secure the two panels together to form the door or drawer assembly.

2. The assembly as described in claim 1, further comprising an insert panel captured between the escutcheon plate on the first panel and the 'U'-shaped portion on the second panel.

3. The assembly as described in claim 2, further comprising one or more "C" clips for fastening the insert panel to a portion of the leg of the 'U'.

4. The assembly as described in claim 1, wherein said deformable member is selected from the group consisting of a plastic rivet, a plastic screw, a rubber plug, a bumper or a button.

5. The assembly as described in claim 1, wherein the escutcheon plate is fastened by a weld.

6. The assembly as described in claim 1, wherein said deformable member distorts and changes shape to at least partially conform to the shape of the capturing aperture when the first panel is assembled to the second panel.

7. A door or drawer assembly having an insert panel therein, comprising:

a rear sheet metal panel having a major plane and four outer walls formed at right angles to the major plane, two or more of the walls having apertures disposed therein, and having a port in the major plane for receiving the insert panel, a portion of the major plane at a perimeter of the port bent at a right angle to the major plane to form a perimeter wall around the port;

deformable members each having a head portion and a body portion, the head portion being larger than the body portion, the body portion disposed in the apertures such that the head portion is on an exterior face of the outer walls;

an escutcheon plate welded to the perimeter wall on the side of the perimeter wall that faces the port;

a front sheet metal panel having a major plane, four outer walls at right angles to the major plane with partial apertures formed in two or more of the front panel outer walls such that at least one portion of a perimeter of each partial aperture is open and facing the major plane, and having a port in the major plane corresponding to the port in the rear panel, a portion of the front panel major plane at a perimeter of the port bent in a 'U' shape such that one leg of the 'U' is approximately parallel to the front panel major plane and the open portion of the 'U' shape faces away from the port; and the deformable member head portions at least partially conforming to the shape of the respective partial apertures in the front panel outer walls when the rear sheet metal panel is joined to the front sheet metal panel sufficient to capture the insert panel between the escutcheon plate on the rear sheet metal panel and the 'U'-shaped portion on the front sheet metal panel, to create the door or drawer assembly.

8. The assembly as described in claim 7, further comprising one or more "C" clips for fastening the insert panel to a portion of the leg of the 'U'.

9. The assembly as described in claim 7, wherein corner joints of all the outer perimeter walls are pulsed YAG laser welded.

10. An interlocking drawer or door assembly having an insert panel therein, comprising:

a front panel having a major face and an outer perimeter wall, portions of the outer perimeter wall having a laser welded seam and having one or more recesses therein, the front panel further having a port in the major face for receiving the insert panel, a portion of the major face at a perimeter of the port bent in a 'U' shape to form an inner perimeter wall such that one leg of the 'U' is approximately parallel to the front panel major face and the open portion of the 'U' shape faces away from the port;

a rear panel arranged to fit within the front panel, and having a major face and an outer perimeter wall, and having a port in the major face corresponding to the port in the front panel, a portion of the major face at a perimeter of the port bent at a right angle to the major face to form an inner perimeter wall around the port;

an escutcheon plate welded to the rear panel inner perimeter wall on the side that faces the port;

deformable means for fastening selected from the group consisting of a plastic rivet, a plastic screw, a rubber plug, a bumper or a button having a head portion that is larger than a body portion, the body portion disposed in the rear panel outer perimeter wall such that the head portion is situated on an exterior side of the rear panel outer perimeter wall; and the rear panel inserted into the front panel such that the rear panel outer perimeter wall is situated within the front panel outer perimeter wall, and the deformable means head portion distorts and is captured by at least partially conforming to the shape of the one or more recesses to tightly retain the panels together, and sufficient to capture the insert panel between the escutcheon plate on the rear metal panel and the 'U'-shaped portion on the front metal panel.

11. The assembly as described in claim 10, wherein said laser welded seam is pulsed YAG laser welded.

12. A door or drawer assembly having a port therein, comprising:

a first panel having a major plane and outer perimeter walls, and having a port in the major plane, a portion of the major plane at a perimeter of the port formed perpendicular to the major plane to form a wall around the perimeter of the port;

deformable means for fastening selected from the group consisting of a plastic rivet, plastic screws, rubber plugs, bumpers or buttons having a head portion that is larger than a body portion, the body portion disposed in the first panel outer perimeter walls such that the head portion is situated on an exterior side of the outer perimeter walls; and an escutcheon plate fastened to the perpendicularly formed wall on the side of the wall that faces the port;

a second panel having a major plane and outer perimeter walls with blind recesses formed therein, and having a port in the major plane corresponding to the port in the first panel; and the first panel joined to the second panel to form the door or drawer assembly by means of the deformable member head portions deforming to be captured in the blind recesses in the outer perimeter walls of the second panel.

13. The assembly as described in claim 12, further comprising an insert panel captured between the escutcheon plate on the first panel and the major plane on the second panel.

* * * * *